US005779610A

United States Patent [19]

Weihrauch

[11] Patent Number: 5,779,610

[45] Date of Patent: Jul. 14, 1998

[54] ROLL PAINT APPLICATION AND STRUCTURAL ELEMENT FOR THE LATTER

[75] Inventor: Georg Weihrauch, Wald-Michelbach, Germany

[73] Assignee: Sterkel GmbH Pinsel -und Farbrollerwerk, Wolpertswende, Germany

[21] Appl. No.: 835,194

[22] Filed: Apr. 7, 1997

Related U.S. Application Data

[63] Continuation of Ser. No. 392,126, Feb. 22, 1995, abandoned.

[30] Foreign Application Priority Data

Feb. 22, 1994 [DE] Germany ..... 94 02 910 U

[51] Int. Cl.[6] ..... B21B 27/02

[52] U.S. Cl. ..... 492/13; 492/19; 492/36; 15/230.11

[58] Field of Search ..... 492/13, 17, 19, 492/30, 33, 35, 36, 39, 41, 48, 28; 15/230.11

[56] References Cited

U.S. PATENT DOCUMENTS

| | | | |
|---|---|---|---|
| 669,136 | 3/1901 | Collenburg | 492/13 |
| 1,436,155 | 11/1922 | Domy . | |
| 2,694,874 | 11/1954 | Coolidge, Jr. et al. | 492/13 |
| 2,823,402 | 2/1958 | Phillips | 15/132.5 |
| 2,935,757 | 5/1960 | Phillips | 492/17 |
| 3,082,459 | 3/1963 | Johnson | 492/13 |
| 4,573,233 | 3/1986 | Stoop | 15/230.1 |
| 4,742,597 | 5/1988 | LaFlamme | 15/244.2 |

FOREIGN PATENT DOCUMENTS

| | | | |
|---|---|---|---|
| 794539 | 2/1936 | France | 7/1 |
| 232455 | 3/1911 | Germany . | |
| 402227 | 9/1924 | Germany . | |
| 688914 | 3/1940 | Germany . | |
| 2031113 | 4/1980 | United Kingdom . | |

*Primary Examiner*—Irene Cuda
*Attorney, Agent, or Firm*—Antonelli, Terry, Stout, & Kraus, LLP

[57] ABSTRACT

A paint application roll, particularly for a paint roller having a bow-shaped support member provided with a handle and on which the roll can be mounted in rotary manner, has a circular cylindrical carrying body onto whose circumferential surface is applied at least one structural element, which gives the roll surface a height-profiling functionality. Preferably the structural element is held in a replaceable manner on the carrying body and can be a tubular sleeve part externally axially mountable on the carrying body.

20 Claims, 2 Drawing Sheets

ROLL PAINT APPLICATION AND STRUCTURAL ELEMENT FOR THE LATTER

This application is a Continuation of application Ser. No. 08/392,126, filed Feb. 22, 1995, abandoned.

FIELD OF THE INVENTION

The invention relates to a roll for paint application, particularly for a paint roller with a bow-shaped support member provided with a handle and on which the roll can be mounted in rotary manner, the roll having a circular cylindrical carrying body. The invention also relates to a structural element for a corresponding paint application roll.

BACKGROUND OF THE INVENTION

For the application of paint to walls or ceilings, apart from brushes, use is frequently made of so-called paint rollers, which have a bow-shaped support member bent from steel wire and provided with a handle. Onto the substantially linearly directed, free end of the support member can be applied a paint application roll and this can be fixed to the support member by clamping or locking. The roll has a circular cylindrical shape and carries on its outside a coating formed from a plush, non woven, fleece, foam or hide layer with which the paint can be applied to the surface to be painted.

In order to obtain coloured structured wall or ceiling surfaces, it is known to initially apply to the surface a relatively rapidly setting, coloured undercoat in as uniform a manner as possible. Onto the undercoat is applied a top coat, which can be worked for a relatively long time. A paint roll provided with a structured or height-profiled surface is then rolled over the top coat, so that in the latter is formed a structured pattern. However, it is alternatively possible to apply the paint directly with the paint roll provided with the structured surface. However, in both cases a corresponding roll must be kept in reserve for each pattern to be formed, which is not only unfavourable from the storage standpoint, but also economically and cost wise.

The problem solved by the invention is to provide a roll for paint application or a structural element for a corresponding roll making it possible to apply different structures with the same roll.

SUMMARY OF THE INVENTION

With respect to the roll, this invention solves the problem of the prior art by providing on the circumferential surface of the carrying body at least one structural element, which gives the roll surface a height-profiling.

A known paint application roll has a uniform jacket or surface. The surface can be smooth, i.e. can be formed by a circular cylindrical carrying body with solid or slightly elastic plastic or rubber surface. However, it is also possible to form on the carrying body of the roll a resilient, paint-absorbing layer, particularly a plush, non woven, fleece or foam layer. According to the invention it is possible in all cases to apply to the circumferential surface of the carrying body at least one structural element, which only covers part of the circumferential surface of the carrying body. Thus, in certain areas the roll surface corresponds to the circumferential surface of the carrying body, whereas in other areas it corresponds to the outer surface of the structural elements. This permits a height-profiling or structuring of the roll surface.

The structural element or elements are preferably held interchangeably on the carrying body, so that on the roll can, as desired, be applied different structural elements. As a function of the nature, size and number of the structural elements the profiling of the roll can be varied, so that random patterns can be formed with a single roll.

According to a preferred development of the invention, the structural element is a tubular sleeve part, which can be externally, axially engaged on the carrying body. The sleeve part zonally covers the circumferential surface of the carrying body, so that during the rolling process in the covered areas the surface structure of the sleeve part and in the uncovered areas the surface structure of the carrying body is decisive for the paint application or structuring. If, according to a possible development of the invention, the sleeve part extends substantially over the entire length of the carrying body, the paint application characteristics of the roll can be completely changed. Thus, for example a carrying body with a smooth, hard surface can be transformed into a roll with a soft covering or vice versa.

It is particularly advantageous to use a sleeve part with radial openings. If in this case a carrying body with a plush covering or the like and a sleeve part with a smooth, hard surface is used, the areas of the plush covering not covered as a result of the openings can pass through the sleeve part at the openings and project from the same. Thus, at least zonally the roll is given a structure for paint application corresponding to the arrangement of the openings. It is also possible to provide the sleeve part with a covering of the aforementioned type. If in this case radial openings are provided in the sleeve part, the roll is at least zonally given a structure in which in the areas of the openings the surface of the carrying body is decisive for the paint application.

If the length of the sleeve part only corresponds to a fraction of the length of the carrying body, it is possible to mount several tubular sleeve parts, independently of one another, on the carrying body. Such sleeve parts can in the form of sleeve disks be arranged in random manner to one another and for paint application can be constructed with or without a covering, as well as with or without openings. The possibility also exists of arranging the sleeve parts or sleeve disks either substantially parallel or inclined to one another with the same or different reciprocal spacings, constructing them with the same or different lengths or providing them with specially shaped edges, particularly serrated edges.

According to another preferred development of the invention the structural element is a cover part which can be mounted on the carrying body. Such a cover part is not pushed laterally, i.e. axially onto the carrying body and is instead applied radially thereto and is, for example, fixed to the carrying body surface by means of a Velcro fastener. The cover part can have a random construction. For example dots, blotches, rings, stars or other patterns can be applied, which can in each case have or not have openings. The cover parts, like the aforementioned sleeve parts, can also be given a smooth, relatively hard surface or a paint application covering, i.e. a plush layer or the like.

The structural elements can be held in positive and/or non-positive manner on the carrying body. If the structural element is an axially fittable sleeve part, then according to a preferred development of the invention the internal diameter of the sleeve part is slightly smaller than the external diameter of the carrying body. Particularly if the carrying body is provided with a resilient paint application layer, it is possible to push the sleeve part onto the carrying body, accompanied on the one hand by its slight, elastically radially outwardly directed deformation and on the other by radially inwardly directed deformation of the covering thereof, the sleeve part being held by means of the frictional forces which occur, as well as the radially directed, elastic securing forces on the carrying body. To make matters easier, it is optionally possible to provide the sleeve part longitudinally with a preferably corrugated longitudinal slot, which facilitates pushing on.

With respect to the structural element for a paint application roll, the aforementioned set problem is solved in that the structural element can be fitted to the circumferential surface of the carrying body and consequently gives the roll a height-profiling.

With the aid of a structural element the known rolls or carrying bodies can be subsequently transformed into a roll with a structured surface, the shaping of the surface structure falling within the random activity of the user. The structural element according to the invention has the aforementioned features and is in particular constructed as a tubular sleeve part or as a cover part.

BRIEF DESCRIPTION OF THE DRAWINGS

The invention is described in greater detail hereinafter relative to a non-limitative embodiment and with reference to the attached drawings, wherein.

DETAILED DESCRIPTION OF THE EMBODIMENTS

Figure 1:
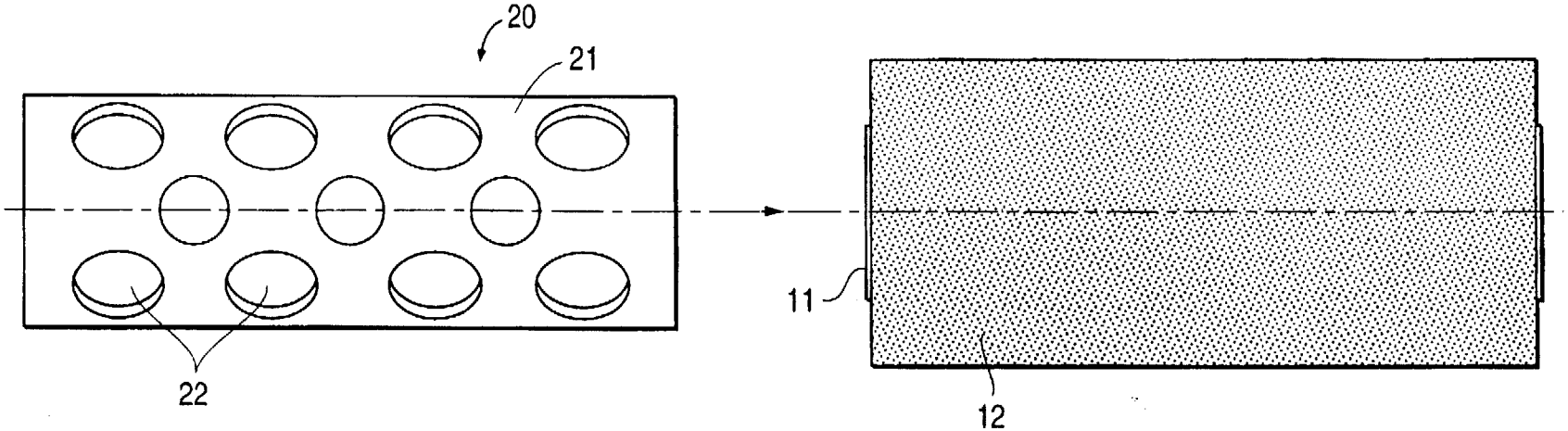
FIG. 1 illustrates a support part and a sleeve part prior to assembly.

According to FIG. 1 a carrying body 11 in the form of a known paint roll is provided and has on its outside a plush covering 12 or the like for paint application. The carrying body 11 can be engaged in known manner onto the free end of a bow-shaped support member (not illustrated ) on which it is rotatably mounted.

Onto the plush covering 12 of the carrying body 11 can be pushed a structural element 20 in the form of a tubular sleeve part 21, which is made from a rigid plastic and provided with a plurality of radial openings 22. The internal diameter of the sleeve part 21 is smaller than the external diameter of the carrying body 11 provided with the plush covering 12.

Figure 2:
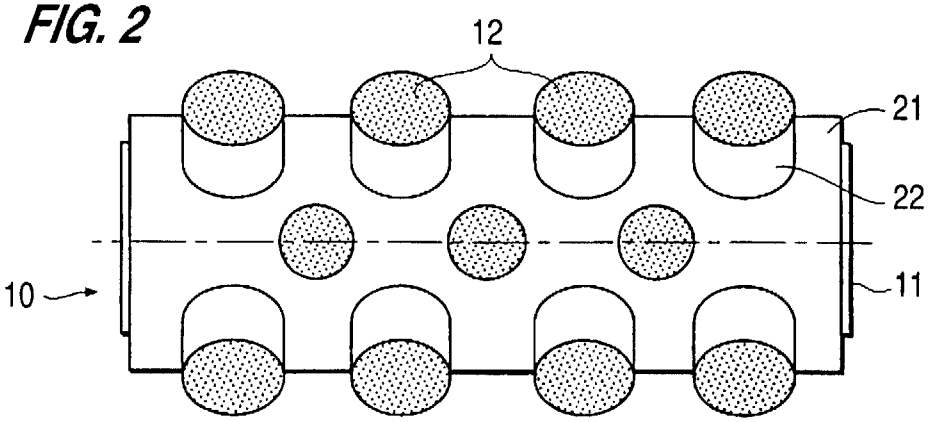
FIG. 2 illustrates the components according to FIG. 1 after assembly.

After engaging the tubular sleeve part 21 in axial manner on the carrying body 11, a paint roll 10 with a structured or height-profiled surface is obtained, as shown in FIG. 2. The plush covering 12 projects from openings 22 of the sleeve part 21 and consequently determines the surface structure.

Figure 3:
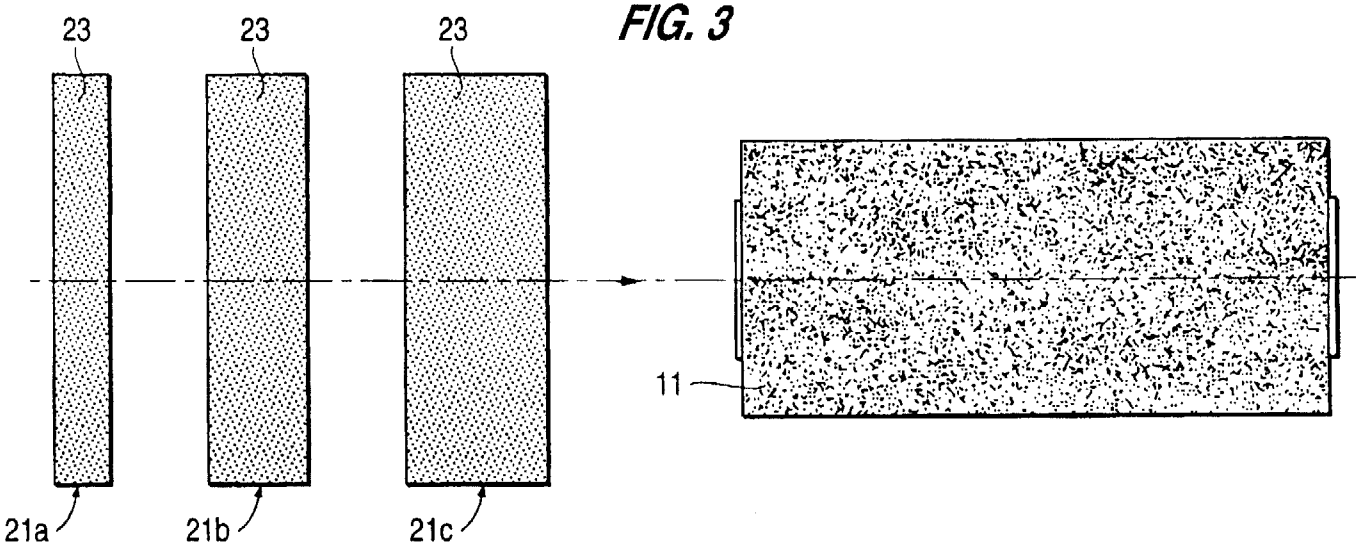
FIG. 3 illustrates a support part and several sleeve parts before assembly.
Figure 4:
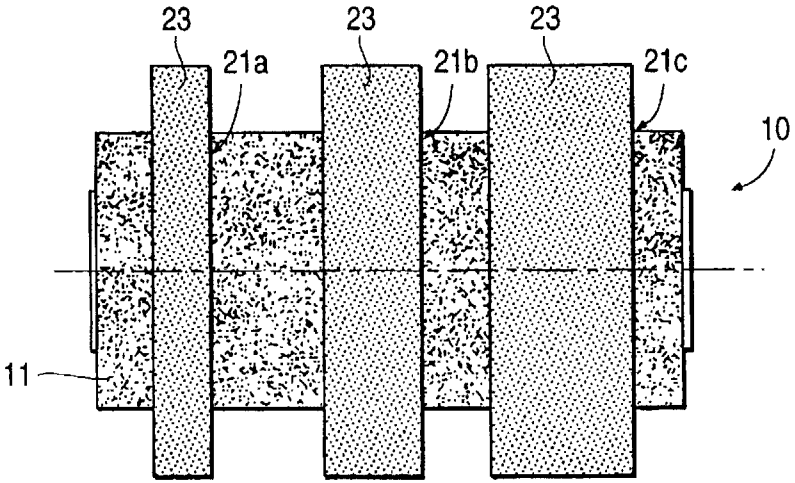
FIG. 4 illustrates the components according to FIG. 3 after assembly.

Whereas in the illustrated embodiment the sleeve part 21 has substantially the same length as the carrying body 11, FIGS. 3 and 4 show a further embodiment, in which the structural elements are constituted by several, short, varyingly width sleeve parts 21*a*, 21*b* and 21*c*.

A carrying body 11 in the form of a circular cylindrical roll has a smooth and relatively hard surface made from rubber or plastic. Onto the carrying body 11 can be axially pushed the sleeve parts 21*a*, 21*b* and 21*c*, which in each case have on their outer surface a plush covering 23 or the like for paint application. After the sleeve parts 21*a*, 21*b* and 21*c* have been placed on the carrying body 11, the paint roll 10 has a jacket or surface with height-profiling or structuring, the paint application being determined by the sleeve parts 21*a*, 21*b* and 21*c*.

I claim:

1. A roll for paint application, for use with a paint roller provided with a handle and on which the roll can be mounted in rotary manner, comprising:

a circular cylindrical carrying body having a paint application layer on an outer surface of the circular cylindrical carrying body with the paint application layer being one of a non woven, a fleece or a foam layer and at least one structural element in the form of a tubular sleeve member disposed over the paint application layer and with openings extending through the tubular sleeve member and portions of the paint application layer projecting through and radially outward from the openings.

2. A roll according to claim 1 wherein:

the structural element is replaceably held on the circular cylindrical carrying body and is pulled over the cylindrical carrying body.

3. A roll according to claim 2 wherein:

the at least one structural element is held frictionally on the circular cylindrical carrying body.

4. A roll according to claim 2 wherein:

an internal diameter of the tubular sleeve member is smaller than an external diameter of the circular cylindrical carrying body.

5. A roll according to claim 2 wherein:

the at least one structural element is held by means of a Velcro fastener on the circular cylindrical carrying body.

6. A roll according to claim 1 wherein:

the tubular sleeve part extends substantially over the entire length of the circular cylindrical carrying body.

7. A roll according to claim 1 wherein:

the at least one structural element is held frictionally on the circular cylindrical carrying body.

8. A roll according to claim 1 wherein:

an internal diameter of the tubular sleeve member is smaller than an external diameter of the circular cylindrical carrying body.

9. A roll according to claim 1 wherein:

the at least one structural element is held by means of a Velcro fastener on the circular cylindrical carrying body.

10. A structural element in combination with a paint application roll, the roll having a circular carrying body having a paint application layer on an outer surface which is one of a non-woven, a fleece or a foam, wherein:

the structural element comprises a tubular sleeve member with openings extending through the tubular sleeve member and disposed over the paint application layer with portions of the paint application layer projecting through and radially outward from the openings.

11. A structural element in combination with a paint application roll, according to claim 10 wherein:

the structural element is replaceably held on the paint application layer and is pulled over the paint application layer.

12. A structural element in combination with a paint application roll, according to claim 10 wherein:

the tubular sleeve part extends substantially over the entire length of the paint application layer.

13. A structural element according to claim 10 further comprising:

several tubular sleeve parts, which are shorter than the paint application layer, and which are engageable on the paint application layer independently of one another.

14. A structural element according to claim 10 wherein:

the structural element is a cover part.

15. A structural element according to claim 10 wherein:

the structural element has a smooth surface.

16. A structural element according to claim 10 wherein:

an outer surface of the structural element has a paint application layer which is one of a non woven, a fleece or a foam layer.

17. A structural element in combination with a paint application roll, according to claim 10 wherein:

the structural element is held frictionally on the paint application layer.

18. A structural element in combination with a paint application roll, according to claim 10 wherein:

an internal diameter of the tubular sleeve member is smaller than an external diameter of the paint application layer.

19. A structural element in combination with a paint application roll, according to claim 10 wherein:

the structural element is held by means of a velcro fastener on the paint application layer.

20. A structural element in combination with a paint application roll, according to claim 10 wherein:

the openings are circular.

* * * * *